US009622526B2

(12) United States Patent
Nakagawa

(10) Patent No.: US 9,622,526 B2
(45) Date of Patent: Apr. 18, 2017

(54) GLOVE, AND METHOD FOR PRODUCING THE SAME

(71) Applicant: SHOWA GLOVE CO., Hyogo (JP)

(72) Inventor: Eiichi Nakagawa, Hyogo (JP)

(73) Assignee: SHOWA GLOVE CO., Hyogo (JP)

( * ) Notice: Subject to any disclaimer, the term of this patent is extended or adjusted under 35 U.S.C. 154(b) by 812 days.

(21) Appl. No.: 13/777,127

(22) Filed: Feb. 26, 2013

(65) Prior Publication Data

US 2013/0219588 A1 Aug. 29, 2013

(30) Foreign Application Priority Data

Feb. 28, 2012 (JP) ..... 2012-042517

(51) Int. Cl.
*A41D 19/00* (2006.01)
*A41D 19/015* (2006.01)

(52) U.S. Cl.
CPC ... *A41D 19/01558* (2013.01); *A41D 19/0065* (2013.01)

(58) Field of Classification Search
CPC A41D 19/0082; A41D 19/0058; B29C 41/22; B32B 2255/26
See application file for complete search history.

(56) References Cited

U.S. PATENT DOCUMENTS 2,293,928 A * 8/1942 Beal ..... B29D 99/0067 2/168
2,393,298 A * 1/1946 De Laney ..... A41D 19/0062 2/168
4,284,275 A * 8/1981 Fletcher ..... A63B 49/08 264/293
4,536,890 A * 8/1985 Barnett ..... A41D 19/0065 2/161.6
5,070,540 A * 12/1991 Bettcher ..... A41D 19/0058 156/165
5,948,707 A * 9/1999 Crawley ..... A41D 31/02 428/422

(Continued)

FOREIGN PATENT DOCUMENTS

GB 1 033 923 6/1966
GB 1 235 282 6/1971

(Continued)

*Primary Examiner* — Richale Quinn
(74) *Attorney, Agent, or Firm* — Norris McLaughlin & Marcus, P.A.

(57) ABSTRACT

The glove of the present invention includes: a glove body made from fibers; a first coating layer being applied at least on a palm side region of the external surface of the glove body, and containing a plurality of pores; and a second coating layer being laminated at least on a part of the external surface of the first coating layer, and being constituted with a plurality of particles and a binder thereof. The second coating layer has particle-clustering regions that are scattering. In the glove, the pores preferably include interconnected cells. Also, in the glove, regions other than the particle-clustering regions of the second coating layer preferably have moisture permeability, and a percentage of the total area of the particle-clustering region with respect to the area of the second coating layer is preferably no less than 20% and no greater than 90%.

8 Claims, 2 Drawing Sheets

(56) References Cited

U.S. PATENT DOCUMENTS 6,019,922 A * 2/2000 Hassan ..... A41D 19/0058 264/130
6,044,493 A * 4/2000 Post ..... A41D 19/0065 2/16
6,075,081 A * 6/2000 Nile ..... C08C 1/15 523/335
6,254,947 B1 * 7/2001 Schaller ..... A41D 19/0058 2/161.7
6,766,536 B1 * 7/2004 Aarons ..... A41B 11/008 2/161.3
6,993,793 B1 * 2/2006 Li ..... A41D 19/01558 2/161.8
7,037,579 B2 * 5/2006 Hassan ..... B29C 41/14 428/295.1
7,155,746 B2 * 1/2007 Schorr ..... A41D 13/1209 2/125
7,771,644 B2 * 8/2010 Flather ..... B29C 41/14 2/169
7,814,570 B2 * 10/2010 Hassan ..... A41D 19/0058 2/161.1
7,814,571 B2 * 10/2010 Thompson ..... A41D 19/0065 2/161.6
8,302,215 B2 * 11/2012 Matsunobu ..... B29C 41/14 2/161.6
8,387,167 B2 * 3/2013 Matsunobu ..... B29C 59/022 2/161.1
8,522,363 B2 * 9/2013 Hassan ..... A41D 19/0058 2/161.1
8,709,573 B2 * 4/2014 Hassan ..... B29C 41/14 427/385.5
8,938,814 B2 * 1/2015 Tomono ..... A41D 19/01558 2/161.6
2003/0221239 A1 * 12/2003 Modha ..... B29C 41/14 2/161.7
2005/0136236 A1 * 6/2005 Hassan ..... B29C 41/14 428/297.1
2005/0278828 A1 * 12/2005 Erickson ..... A63B 71/14 2/161.5
2006/0130212 A1 * 6/2006 Kishihara ..... A41D 19/0055 2/161.6
2006/0143767 A1 * 7/2006 Yang ..... A41D 19/015 2/16
2006/0150300 A1 * 7/2006 Hassan ..... A41D 19/0058 2/161.6
2008/0244809 A1 * 10/2008 Hassan ..... A41D 19/0058 2/161.8
2009/0038051 A1 * 2/2009 Fujihana ..... A41D 19/01558 2/161.8
2009/0105424 A1 * 4/2009 Kodama ..... B29C 41/14 525/331.9
2009/0126074 A1 * 5/2009 Mattesky ..... A41D 19/0065 2/161.8
2009/0255033 A1 * 10/2009 Chen ..... A61B 19/04 2/161.7
2011/0164349 A1 * 7/2011 Snyder ..... H01G 11/02 361/525
2011/0265246 A1 * 11/2011 Saito ..... A41D 19/0065 2/168
2013/0219588 A1 * 8/2013 Nakagawa ..... A41D 19/0065 2/168
2014/0115751 A1 * 5/2014 Saito ..... A41D 19/0082 2/168

FOREIGN PATENT DOCUMENTS

| | | |
|---|---|---|
| JP | 2-242968 | 9/1990 |
| JP | 8-209414 | 8/1996 |
| JP | 11-279818 | 10/1999 |
| JP | 2010-144278 | 7/2010 |
| JP | 2011-001662 | 1/2011 |
| JP | 2012-031553 | 2/2012 |

* cited by examiner (1A)

(1B)

GLOVE, AND METHOD FOR PRODUCING THE SAME

BACKGROUND OF THE INVENTION

Field of the Invention

The present invention relates to a glove, and a method for producing the same.

Discussion of the Background

As a glove subjected to an anti-slipping processing, a glove has been known produced by laminating a coating layer on a glove made from fibers using an NBR latex, polyvinyl chloride paste or the like, with anti-slipping particles contained in the coating layer. In addition, the gloves subjected to the anti-slipping processing include gloves having moisture permeability for effectively releasing the moisture such as sweat generated during working, out of the glove.

As such a glove, a glove was developed having an uneven shape formed on the surface of a glove made from fibers by applying a foamed resin containing particles onto the external surface of the glove; and leaving the particles on the surface of the glove while thinning the resin coating film by blowing the foamed resin with air (see Japanese Unexamined Patent Application, Publication No. H2-242968). According to this glove, while achieving an anti-slipping effect due to the uneven shape provided on the surface of the glove, moisture permeability can be attained since a foamed resin is used.

However, the conventional glove is disadvantageous in weak fixing strength of the particles due to having a thin resin coating film; and each anti-slipping particle being likely to be detached since the particles are each stand alone, thereby leading to failure in achieving a sufficient anti-slipping effect.

PRIOR ART DOCUMENTS

Patent Documents

Patent Document 1 Japanese Unexamined Patent Application, Publication No. H2-242968

SUMMARY OF THE INVENTION

The present invention was made in view of the foregoing disadvantages, and an object of the invention is to provide a glove having a superior anti-slipping effect, moisture permeability and abrasion resistance, and a method for producing the same.

An aspect of the present invention made for solving the foregoing problems provides a glove including:

a glove body made from fibers;

a first coating layer being applied at least on a palm side region of the external surface of the glove body, and containing a plurality of pores; and a second coating layer being laminated at least on a part of the external surface of the first coating layer, and being constituted with a plurality of particles and a binder thereof, the second coating layer having particle-clustering regions that are scattering.

According to the glove, a second coating layer being constituted with a plurality of particles and a binder thereof, and having particle-clustering regions is formed on the outermost face of at least on a palm side region of the glove body made from fibers as described above, whereby an irregular uneven shape is formed on the surface of the glove; therefore, a superior anti-slipping effect and abrasion resistance can be achieved. Since the particle-clustering regions are formed so as to be scattering on the glove, a superior anti-slipping effect is achieved, and high flexibility is also attained. In addition, the first coating layer has a plurality of pores, and the second coating layer has particle-clustering regions that are scattering in the glove; therefore, the glove is superior in the moisture permeability, and the moisture such as sweat generated from a worker's hand can be effectively released out of the glove, thereby enabling superior wearing feel to be maintained even if worn for a long period of time. Moreover, since the glove achieves weight saving and improved flexibility due to the presence of the pores, hand fatigue is less likely to occur even if used for a long period of time, thereby enabling the working efficiency to be improved.

In the glove, the pores preferably include interconnected cells. Accordingly, the upper face and the lower face of the first coating layer are communicated, whereby the moisture permeability of the glove can be improved. As a result, the moisture such as sweat generated from a worker's hand can be effectively released out of the glove, thereby enabling the wearing feel of the glove to be improved.

In the glove, regions other than the particle-clustering regions of the second coating layer preferably have moisture permeability. Accordingly, the moisture permeability of the glove can be further improved, thereby enabling the wearing feel of the glove to be further improved.

The glove preferably has a percentage of the total area of the particle-clustering regions with respect to the area of the second coating layer of no less than 20% and no greater than 90%. When the percentage of the total area of the particle-clustering regions that are scattering with respect to the area of the second coating layer falls within the above range, a sufficient anti-slipping effect can be imparted to the glove.

In the glove, a mean particle size of the particles is preferably no less than 50 μm and no greater than 900 μm. When the mean particle size of the particles falls within the above range, the particles are likely to be aggregated with one another in forming the particle-clustering regions, whereby the particle-clustering regions having a sufficient area and fixing property can be formed. As a result, a sufficient anti-slipping effect can be imparted to the glove.

According to the glove, the content of the particles is preferably no less than 50 parts by mass and no greater than 500 parts by mass in terms of the solid content with respect to 100 parts by mass of the binder of the second coating layer. When the content of the particles with respect to 100 parts by mass of the binder of the second coating layer falls within the above range, the particle-clustering regions and regions other than the particle-clustering regions can be appropriately scattering when the particle-clustering regions are formed, without filling of the second coating layer with the particles. As a result, flexibility of the glove can be improved.

In the glove, a mean water vapor transmission rate of the region on which the second coating layer is laminated is preferably no less than 1,000 $g/m^2 \cdot 24$ hrs. When the mean water vapor transmission rate of the region on which the second coating layer is laminated is greater than the above lower limit, wearing feel of the glove can be improved.

In the glove, the particles are preferably made of a rubber or a resin. Accordingly, the particle-clustering regions have appropriate elasticity, and the anti-slipping effect of the glove is improved, and further an object to be gripped can be prevented from being scratched.

In addition, another aspect of the invention made for solving the foregoing problems provides a method for producing a glove, the method including:

a first coating layer-forming step for forming a first coating layer at least on a palm side region of the external surface of a glove body made from fibers using a foamed first coating layer-forming material; and a second coating layer-forming step for forming a second coating layer at least on a part of the external surface of the first coating layer by overlaying a second coating layer-forming material containing a plurality of particles, in which the second coating layer-forming step includes: immersing the glove body, on which the first coating layer was formed, in a second coating layer-forming material; withdrawing the glove body therefrom; and then allowing the second coating layer-forming material to flow, whereby the plurality of particles are aggregated to form particle-clustering regions.

According to the method for producing a glove, the glove having a first coating layer containing pores at least on a palm side region of the external surface of a glove body made from fibers, and further having a second coating layer having particle-clustering regions that are scattering laminated on the external surface of the first coating layer can be produced. The glove produced by this method has a superior anti-slipping effect, moisture permeability and abrasion resistance as described above.

In the second coating layer-forming step, after the glove body on which the first coating layer was formed is withdrawn from the second coating layer-forming material, it is preferred to retain the glove body in state in which fingertip portions are directed downward, whereby the plurality of particles are aggregated to form the particle-clustering regions. After the second coating layer-forming material is applied to the glove body on which the first coating layer was formed, the glove body is retained in a state in which fingertip portions are directed downward, whereby a plurality of particles form particle-clustering regions while flowing downward on the surface of the glove; therefore, the particle-clustering regions that are uniformly scattering entirely can be formed on the second coating layer. As a result, the anti-slipping effect of the glove obtained by the method for producing a glove can be improved.

The viscosity of the second coating layer-forming material is preferably no less than 100 mPa·s and no greater than 900 mPa·s. When the viscosity of the second coating layer-forming material falls within the above range, the particle-clustering regions having an adequate area can be formed. As a result, the anti-slipping effect and the moisture permeability of the glove obtained by the method for producing a glove can be well balanced.

It is to be noted that the term "palm side region" as referred to in the glove and the method for producing the same means a portion which covers from the wrist to the tip(s), and faces to an object upon gripping.

As explained in the foregoing, the present invention can provide a glove having a superior anti-slipping effect, moisture permeability and abrasion resistance, and a method for producing the same.

BRIEF DESCRIPTION OF THE DRAWINGS

FIG. 15 shows an enlarged view of a circumscribed portion A in FIG. 1A;

Hereinafter, preferred modes for carrying out the present invention will be explained in detail with appropriate references to the drawings.

Figure 1:
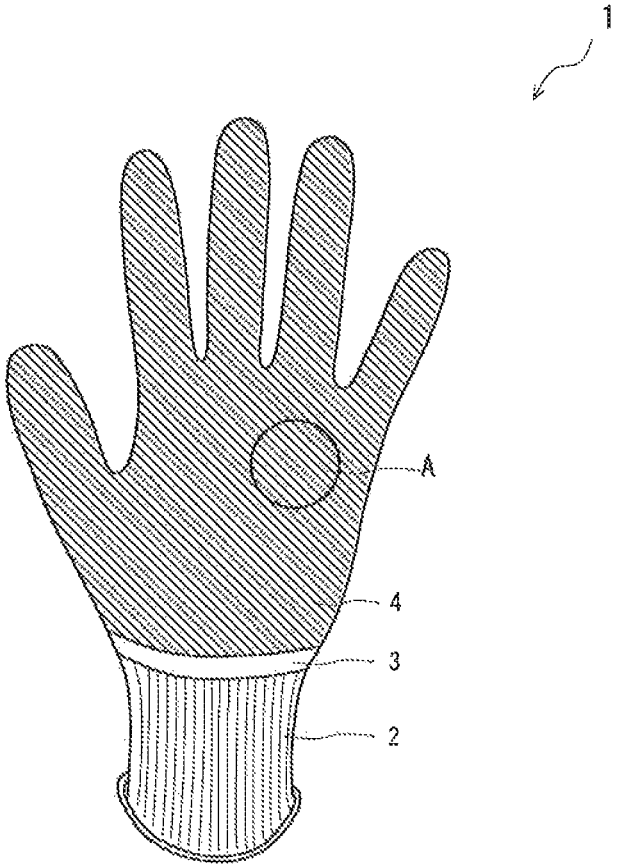
FIG. 1A shows an explanatory view illustrating a glove according to a first embodiment of the present invention viewed from a palm side.
Figure 1:
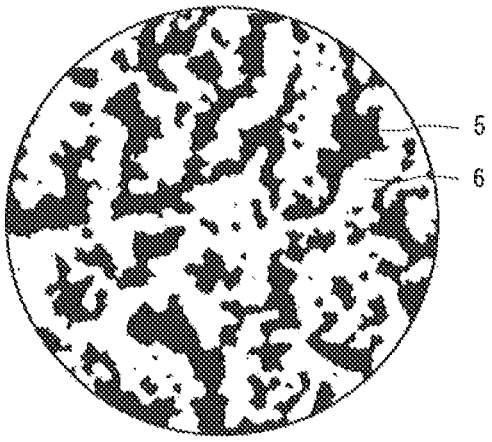

The glove 1 has, as shown in FIG. 1A, a glove body 2 made from fibers, a first coating layer 3 applied at least on a palm side region of the external surface of the glove body 2, and a second coating layer 4 further laminated at least on a part of the external surface of the first coating layer 3. In addition, as shown in FIG. 1B, the second coating layer 4 has particle-clustering regions 5 that are scattering. It is to be noted that oblique lines in FIG. 1A are not lines that actually appear on the surface of the glove but lines drawn to visually clarify scattering of the particle-clustering regions 5 on the entire face of the second coating layer 4 as shown in the enlarged view of FIG. 1E.

Glove Body

The glove body 2 is organized in a glove shape by knitting a thread which can be used in a knitting process such as a thread obtained, by twisting fibers or a thread obtained by collectively twisting fibers, and thus has breathability. The fibers constructing the thread employed can be a variety of fibers, and examples of the fiber include cotton, hemp, nylon fibers, polyester fibers, rayon fibers, acryl fibers, polyurethane fibers, aramid fibers such as polyparaphenyleneterephthalamide fibers (trade name: "Kevlar (registered trademark)", manufactured by Du Pont Kabushiki Kaisha, etc.), polymetaphenyleneisophthalamide fibers, ultra high-intensity polyethylene fibers (trade name: "Dyneema (registered trademark)", manufactured by Toyobo Co., Ltd., etc.), metal composite fibers or glass composite fibers produced by covering a stainless wire or a glass fiber with nylon, etc., and the like. These may be used either alone, or as a mixture of two or more types thereof. Of these, in light of superior flexibility and versatility, cotton and polyester fibers are preferred, and cotton is more preferred. Cotton threads obtained by collectively twisting cotton have appropriate bulkiness, and can suppress the impregnation of the first coating layer-forming material described later.

The type of the fiber may be appropriately changed in accordance with the intended usage of the glove 1. For example, the type of the fiber is preferably an aramid thread and a cotton thread for heat resistant purposes, an aramid thread and an ultra high-intensity polyethylene thread as well as a metal composite thread and a glass composite thread for cut wound-preventing purposes, and a filament thread of nylon fibers or polyester fibers for dust emission-preventing purposes.

In addition, in order to improve a feel upon touch of the glove the thread constituted with the fibers may be subjected to a crimping processing. The thread subjected to a crimping processing is exemplified by woolly nylon threads and woolly polyester thread, and woolly nylon threads superior in the strength are preferred among these.

Although the glove body 2 is formed by knitting the thread constituted with the fibers, it may be also formed by cutting, into a glove shape, a knitted fabric, or woven fabric or nonwoven fabric provided using the fibers, followed by sawing. In particular, the glove body 2 knitted using a seamless knitting machine is preferred in light of the absence of seam and superior flexibility.

When a glove provided by knitting is used as the glove body 2, the number of the gauge of the knitting is not particularly limited as long as the glove body 2 having appropriate strength and flexibility can be obtained, and for example, the number of the gauge of the knitting is preferably no less than 10 and no greater than 18 in the case in which the glove body 2 is knitted with a seamless knitting machine using 1 to 6 pieces of a cotton thread of cotton yarn number of 20.

The mean thickness of the glove body 2 is preferably no less than 0.1 mm and no greater than 1.7 mm, and more preferably no less than 0.3 mm and no greater than 1.5 mm. When the mean thickness of the glove body 2 is greater than the upper limit value described above, the thickness of the glove 1 may be so great that flexibility may be decreased. To the contrary, when the mean thickness of the glove body 2 is less than the lower limit value described above, the strength and durability of the glove body 2 may be reduced. The mean thickness an average value obtained by measuring the thicknesses of a fabric that constructs the glove body 2 at arbitrary five points using "Thickness Gauge SERIES 547-301 (manufactured by Mitutoyo Corporation)".

A cuff portion of the glove body 2 is provided to have stretchability in a circumferential direction, thereby enabling stretching and contraction along a radial direction. In addition, a portion at the fingertip side from the cuff portion of the glove body 2 is also provided to enable stretching and contraction along a radial direction due to having stretchability in a circumferential direction. In these regards, it is preferred that the cuff portion be formed to have greater stretchability as compared with other portion (i.e., the portion at the fingertip side from the cuff portion) so as to make the diameter thereof in the contracted state less than the wrist size of putative wearers. Accordingly, a gap is not generated between the cuff portion of the glove body 2 and the wrist of the wearer in use, whereby a better fit can be attained and unwanted detachment of the glove 1 can be prevented. Additionally, the palm portion of the glove body 2 is provided such that the diameter in the contracted state is preferably slightly less than the outer perimeter of the palm of putative wearers, and more preferably almost equal thereto. Accordingly, the glove 1 well fits the palm of the wearer in use, thereby enabling a superior wearing feel to be imparted.

The glove body 2 may be subjected to various types of treatments using, for example, a softening agent, a water-repellent agent, an oil-repellent agent, an antimicrobial, or the like. In addition, an ultraviolet ray preventing function may be imparted by application or impregnation of an ultraviolet ray absorbing agent, etc.

First Coating Layer

Figure 2:
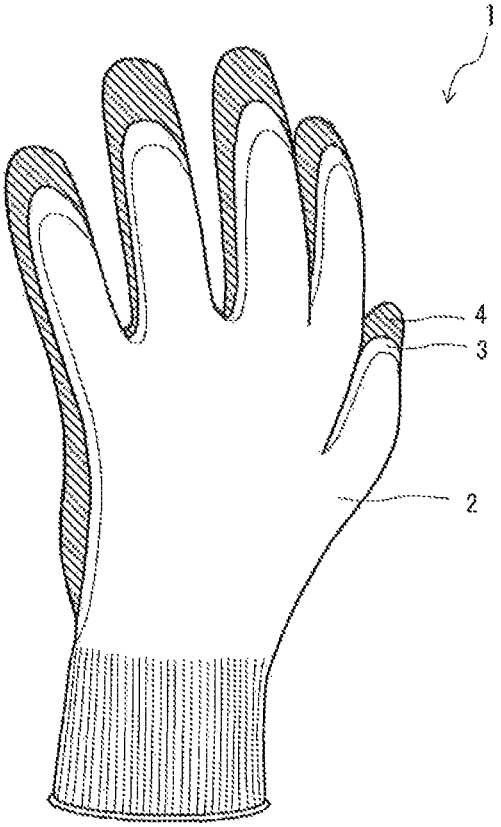
FIG. 2 shows an explanatory view illustrating the glove according to the first embodiment of the present invention viewed from a back side.

The first coating layer 3 is formed at least on a palm side region of the external surface of the glove body 2. Specifically, as shown in FIG. 1A and FIG. 2, the first coating layer 3 is formed on the entire face of the palm side region, and the outer periphery of the back region (i.e., back face side of the palm side region, corresponding to a region covering the wrist position to fingertip positions on the face of the external side when a substance is gripped) of the glove body 2. Moreover, a central portion of the back region of the glove body 2 may include a region without the first coating layer 3 formed, forming an unlined back.

Figure 3:
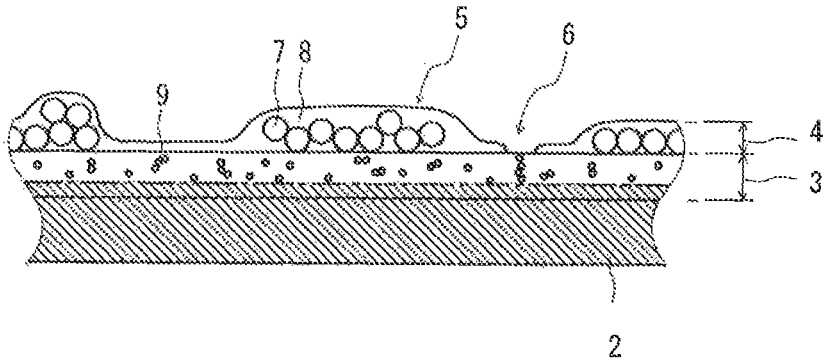
FIG. 3 shows a schematic cross sectional view of a part of the glove shown in FIG. 1.

A part of the first coating layer 3 is impregnated into the superficial layer of the glove body 2 as shown in FIG. 3. Thus, the first coating layer 3 is rigidly fixed on the glove body 2, and detachment of the first coating layer 3 can be inhibited. Although the glove body 2 is schematically illustrated in FIG. 3, the impregnating portion of the first coating layer 3 includes fibers of the glove body 2, thereby making a state in which the material of the first coating layer 3 is invaded into the gap of the fibers of the glove body 2.

The first coating layer 3 entirely contains a plurality of pores 9 and thus has moisture permeability. A part of the plurality of pores 9 are embedded into the first coating layer 3, in other words, gas such as air is included in closed spaces. Whereas, other parts of the pores 9 are present as concave pore scars on the surface of the first coating layer 3. The pores 9 are minute and nearly spherical, and can be formed during forming the first coating layer 3 in the production step of the glove 1 described later, by foaming the first coating layer-forming material beforehand to include fine pores.

The mean diameter of the pores 9 is preferably no less than 1 μm and no greater than 100 μm, and more preferably no less than 5 μm and no greater than 80 μm. When the mean diameter of the pores 9 is greater than the upper limit value, the strength of the first coating layer 3 may be decreased. To the contrary, when the mean diameter of the pores 9 is less than the lower limit value described above, too small each pore may lead to failure in attaining sufficient moisture permeability and flexibility. The "mean diameter" is a value derived by averaging the lengths of a major axis and a minor axis of arbitrary ten pores 9.

In addition, the pores 9 preferably include interconnected cells. When interconnected cells constructing a structure in which at least two pores 9 are interconnected are included in the first coating layer 3, the top face and the back face are communicated, whereby the moisture permeability of the glove 1 can be improved. As a result, moisture such as sweat generated from a wearer's hand can be effectively released from inside the glove, whereby improvement of the wearing feel of the glove 1 is enabled.

The percentage of the total area of the pores 9 in an arbitrary cross section of the first coating layer 3 is preferably no less than 10% and no greater than 90%, and more preferably no less than 20% and no greater than 80%. When the percentage of the total area of the pores 9 is greater than the upper limit value described above, the strength of the first coating layer 3 may be decreased. To the contrary, when the percentage of the total area of the pores 9 is less than the lower limit value described above, the glove 1 may not have sufficient moisture permeability and flexibility. It is to be noted that the percentage of the total area of the pores 9 is a value obtained by measuring the area of the pores 9 in 1 $cm^2$ of an arbitrary cross section of the first coating layer 3 using "Digital Microscope VHX-900" manufactured by Keyence Corporation.

The number of the pores 9 is preferably no less than 10 and no greater than 10,000 on average per $cm^2$ of the cross sectional area of the first coating layer 3. When the number of the pores 9 is greater than the upper limit value described above, the strength of the first coating layer 3 may be decreased. To the contrary, when the number of the pores 9 is less than the lower limit value described above, the first coating layer 3 may not have sufficient moisture permeability and flexibility.

The percentage of the volume of the pores 9 in the first coating layer 3 is preferably no less than 10% and no greater than 90%, and more preferably no less than 20% and no greater than 80%. When the percentage of the volume of the pores 9 is greater than the upper limit value described above, the strength of the first coating layer 3 may be decreased, whereby the first coating layer 3 may be likely to be damaged. To the contrary, when the percentage of the volume of the pores 9 is less than the lower limit value described above, the first coating layer 3 may not have sufficient moisture permeability and flexibility.

The mean thickness of the first coating layer 3 is preferably no less than 0.2 mm and no greater than 2.0 mm, and more preferably no less than 0.4 mm and no greater than 1.5 mm. When the mean thickness of the first coating layer 3 is greater than the upper limit value described above, the glove 1 may be too thick and thus the flexibility may be decreased. To the contrary, when the mean thickness of the first coating layer 3 is less than the lower limit value described above, formation of the first coating layer 3 may be difficult. Furthermore, the first coating layer 3 is preferably laminated to give a thickness that results in concealing of the unevenness formed by the thread constructing the glove body 2, and specifically, a distance from the surface of the glove body 2 to the external surface of the first coating layer 3 is preferably no less than 0.1 mm. Herein, the mean thickness of the first coating layer 3 involves a thickness of the impregnated portion in the glove body 2.

A principal component of the first coating layer 3 is exemplified by a rubber, a resin, and the like. Examples of the rubber include a styrene-butadiene rubber, a nitrile butadiene rubber, a urethane rubber, an isoprene rubber, an acryl rubber, a chloroprene rubber, a butyl rubber, a butadiene rubber, a fluorine rubber, an epichlorohydrin rubber, an ethylene-propylene rubber, natural rubbers, and the like. In addition, examples of the resin include a polyvinyl chloride-based resin, an acrylic resin, a polyethylene-based resin, a polypropylene-based resin, a polystyrene-based resin, a silicone-based resin, a polyurethane-based resin, a polyvinyl alcohol-based resin, a vinylidene chloride-based resin, a chlorinated polyethylene-based resin, a polycarbonate-based resin, a phenol-based resin, an ethylene-vinyl alcohol copolymer resin, and the like. These may be used either alone, or in combination of two or more types thereof. Also, the principal component may be dispersed in a dispersion liquid such as water; dissolved in a solvent such as toluene, xylene, N,N-dimethyl formamide, acetone, isopropyl alcohol, methylethylketone or N-methylpyrrolidone; or dispersed in a plasticizer or the like to give a latex or emulsion having a paste sol form, which may be used (hereinafter, the dispersion liquid and the solvent may be also referred to collectively as "diluent"). Of these, the principal component of the first coating layer 3 is preferably a rubber in light of superior elasticity, processability and economical efficiency, and more preferably a natural rubber latex. When a natural rubber latex is used as the principal component of the first coating layer 3, the pores 9 can be more easily formed, and thus formation of the interconnected cells is facilitated, whereby the moisture permeability and flexibility of the glove 1 can be improved. It is to be noted that the natural rubber means an elastic material which is derived from sap collected from a plant and includes polyisoprene.

When a rubber a resin which necessitates vulcanization is used as a principal component of the first coating layer 3, sulfur is preferably used as a crosslinking agent. The amount of sulfur blended is preferably no less than 0.1 parts by mass and no greater than 3 parts by mass in terms of the solid content with respect to 100 parts by mass of the principal component of the first coating layer 3. When the amount of sulfur blended is greater than the upper limit value described above, a feel of the first coating layer 3 may be stiff and hard. To the contrary, when the amount of sulfur blended is less than the lower limit value described above, crosslinking may be insufficient, and thus basic characteristics such as tensile strength may be less likely to be attained. In addition, a peroxide may be used to carry out peroxide crosslinking.

The first coating layer 3 may further contain other additive in addition to the principal component described above. The other additive is exemplified by a vulcanization accelerator, an anti aging agent the anti-aging agent including an antioxidant, an ozone deterioration-preventing agent), a metal oxide, a pigment, a plasticizer, a stabilizer, a thickener, and the like.

The vulcanization accelerator is exemplified by aldehyde-ammonia type, aldehyde-amine type, thiourea type, guanidine type, thiazole type, sulfonamide type, thiram type, dithiocarbamic acid salt type, xanthic acid salt type vulcanization accelerators, and the like. These may be used either alone, or in combination of two or more thereof. Of these, dithiocarbamic acid salt type vulcanization accelerators are preferred, and zinc diethyldithiocarbamate is more preferred. The amount of the vulcanization accelerator blended is preferably no less than 0.1 parts by mass and no greater than 5 parts by mass in terms of the solid content with respect to 100 parts by mass of the principal component of the first coating layer 3. When the amount is greater than the upper limit value described above, a feel upon touch of the first coating layer 3 may be hard, or initial vulcanization may progress and thus a scorch phenomenon may occur. To the contrary, when the amount of the vulcanization accelerator blended is less than the lower limit value described above, the effect of accelerating vulcanization may be insufficient.

Examples of the anti-aging agent include phenol type antioxidants such as 2,6-di-tert-p-butyl-p-cresol, 2,6-di-tert-butylphenol, 2,4-dimethyl-6-tert-butylphenol, 4,4-dihydroxydiphenyl, tris(2-methyl-4-hydroxy-5-tert-butylphenyl) butane, and 2,2'-methylenebis(6-tert-butyl-p-cresol); phosphite type antioxidants; thio ether type antioxidants, and the like. Of these, phenol type antioxidants are preferred, and 2,2'-methylenebis(6-tert-butyl-p-cresol) and 2,2-methylenebis(4-methyl-6-tert-butyl-phenol) are more preferred. The amount of the antioxidant blended is preferably no less than 0.1 parts by mass and no greater than 3 parts by mass in terms of the solid content with respect to 100 parts by mass of the principal component of the first coating layer 3. When the amount of the antioxidant blended is greater than the upper limit value described above, the effects comparable to those achievable by the additive amount may not be sufficiently exhibited, and thus economical efficiency may be lowered and/or physical properties may be impaired. To the contrary, when the amount of the antioxidant blended is less than the lower limit value described above, sufficient oxidization-preventing effect may be hardly achieved.

Examples of the metal oxide include zinc oxide, oxidization lead, trilead tetraoxide, and the like. These may be used either alone, or in combination of two or more types thereof. The amount of the metal oxide blended is preferably no less than 0.1 parts by mass and no greater than 10 parts by mass in terms of the solid content with respect to 100 parts by mass of the principal component of the first coating layer 3. When the amount of the metal oxide blended is greater than the upper limit value described above, a feel upon touch of the first coating layer 3 may be stiff and hard. To the contrary, when the amount of the metal oxide blended is less than the lower limit value described above, the crosslinking may be insufficient, whereby basic characteristics such as tensile strength may be less likely to be attained. Note that when the strength of the first coating layer 3 is sufficiently attained, it is not necessary to use the metal oxide.

Examples of the pigment include titanium oxide, carbon black, and the like. Although the amount of the pigment blended may be appropriately determined according to the pigment type, the degree of coloring and the like, the amount is preferably no less than 0.01 parts by mass and no greater than 20 parts by mass in terms of the solid content with respect to 100 parts by mass of the principal component of the first coating layer 3. When the amount of the pigment blended is greater than the upper limit value described above, color formation effect comparable to those achievable by the additive amount may be inferior and thus economical efficiency may be lowered and/or physical properties may be decreased. To the contrary, when the amount of the pigment blended is less than the lower limit value described above, sufficient coloring effect may not be achieved.

Examples of the plasticizer include: phthalic acid esters such as dimethyl phthalate, diethyl phthalate, dibutyl phthalate, diisobutyl phthalate, dioctyl phthalate, butyloctyl phthalate, di-(2-ethylhexyl) phthalate, diisononyl phthalate, diisooctyl phthalate and diisodecyl phthalate; fatty acid esters such as dimethyl adipate, diisobutyl adipate, di-(2-ethylhexyl) adipate, diisononyl adipate, diisooctyl adipate, diisodecyl adipate, octyldecyl adipate, di-(2-ethylhexyl) azelate, diisooctyl azelate, diisobutyl azelate, dibutyl sebacate, di-(2-ethylhexyl) sebacate and diisooctyl sebacate; trimellitic acid esters such as trimellitic acid isodecyl ester, trimellitic acid octyl ester, trimellitic acid n-octyl ester and trimellitic acid-based isononyl ester, as well as alkylsulfonic acid phenyl esters, di-(2-ethylhexyl) fumarate, diethylene glycol monooleate, glyceryl monoricinoleate, trilauryl phosphate, tristearyl phosphate, tri-(2-ethylhexyl) phosphate, tricresyl phosphate, epoxidized soybean oil or polyether ester, and the like. These may be used either alone, or in combination of two or more types thereof. The amount of the plasticizer blended is preferably no less than 50 parts by mass and no greater than 200 parts by mass in terms of the solid content with respect to 100 parts by mass of the principal component of the first coating layer 3. When the amount of the plasticizer blended is less than the lower limit value described above, sufficient plasticity may not be obtained. To the contrary, when the amount of the plasticizer blended is greater than the upper limit value described above, a bleeding phenomenon may occur.

The stabilizer is exemplified by a Ba—Zn-based stabilizer, an Mg—Zn-based stabilizer, a Ca—Zn-based stabilizer, and the like. The amount of the stabilizer blended is preferably no less than 1 part by mass and no greater than 10 parts by mass in terms of the solid content with respect to 100 parts by mass of the principal component of the first coating layer 3. When the amount of the stabilizer blended is less than the lower limit value described above, sufficient stability may not be obtained. To the contrary, when the amount of the stabilizer blended is greater than the upper limit value described above, the bleeding phenomenon may be caused by the stabilizer.

The thickener is exemplified by silica fine powder, calcium carbonate fine powder, hydroxypropyl methylcellulose, an acryl emulsion, and the like.

When a polyurethane resin for wet processing is used as the principal component of the first coating layer 3, a film formation auxiliary agent may be used. The film formation auxiliary agent is exemplified by an anionic or nonionic silicone, and the like. The amount of the film formation auxiliary agent blended is preferably no less than 0.1 parts by mass and no greater than 10 parts by mass in terms of the solid content with respect to 100 parts by mass of the principal component of the first coating layer 3. When the amount of the film formation auxiliary agent blended is less than the lower limit value described above, sufficient effects may not be achieved. To the contrary, when the amount of the film formation auxiliary agent blended is greater than the upper limit value described, above, the effects comparable to those achievable by the additive amount may not be sufficiently achieved and thus economical efficiency may be lowered, in this instance, the size and shape of the pores 9 may not fall within the above range due to the difference from mechanical foaming and chemical foaming.

Second Coating Layer

The second coating layer 4 is laminated at least on a part of the external surface of the first coating layer 3, and constituted with particle-clustering regions 5 and regions 6 other than the particle-clustering regions. A portion on which the second coating layer 4 was laminated may include portions where the first coating layer 3 that is an underlayer is exposed. Specifically, as shown in FIG. 1A and FIG. 2, the second coating layer 4 is laminated such that a portion where the second coating layer 4 is not laminated remains in an area of a certain width surrounding the palm side region covering from the external margin of the first coating layer 3 to an inner circumference.

Particle-Clustering Region

The particle-clustering regions 5 are constituted with a plurality of aggregated particles 7 and a binder 8 thereof, and are scattering over the entire face of the second coating layer 4. Accordingly, a fine uneven shape is formed on the surface of the second coating layer 4, whereby an anti-slipping effect of the glove 1 is achieved. The particle-clustering regions 5 include as shown in FIG. 1B, those each having a nonuniform, and singly or multiplely branched shape. By the particle-clustering regions 5 thus having a branched shape, water draining of the surface of the glove 1 can be improved. In addition, the particle-clustering regions 5 are formed to have a top face that is substantially flat. By the particle-clustering regions 5 thus formed to have a top face that is substantially flat, an area of the particle-clustering region 5 brought into contact with the object to be gripped can be broad, and the anti-slipping effect of the glove 1 can be improved.

The mean area of the particle-clustering regions 5 (i.e., a mean area derived by projection of the particle-clustering regions 5 onto a face parallel to the surface of the glove body 2) is preferably no less than 1 $mm^2$ and no greater than 25 $mm^2$, and more preferably no less than 2 $mm^2$ and no greater than 16 $mm^2$. When the mean area of the particle-clustering regions 5 is greater than the upper limit value described above, the particle-clustering regions 5 may be so great that the flexibility and anti-slipping effect of the glove 1 may be decreased when they are formed at sites corresponding to a joint portion of fingers. To the contrary, when the mean area of the particle-clustering region 5 is less than the lower limit value described above, each particle-clustering region 5 may be so small that the anti-slipping effect may not be sufficiently achieved. It is to be noted that the area of the particle-clustering region 5 is a value measured with "Digital Microscope VHX-900" manufactured by Keyence Corporation.

The percentage of the total area of the particle-clustering regions 5 with respect to the area of the second coating layer 4 is preferably no less than 20% and no greater than 90%, more preferably no less than 30% and no greater than 85%, still more preferably no less than 35% and no greater than 70%, and most preferably no less than 40% and no greater than 60%. When the percentage of the total area of the particle-clustering region 5 is greater than the upper limit value described above, the area of the particle-clustering regions 5 on the second coating layer 4 is so great that the flexibility of the glove 1 may be deteriorated due to a decrease in the unevenness of the surface, and attaining a sufficient moisture permeability may fail due to a relative decrease in the regions 6 other than the particle-clustering regions. To the contrary, when the percentage of the total area of the particle-clustering regions 5 is less than the lower limit value described above, the anti-slipping effect of the glove 1 may not be sufficiently achieved. Note that the percentage of the total area of the particle-clustering regions 5 as herein referred to means a percentage of a sum of areas of a plurality of particle-clustering regions 5 with respect to the area of the second coating layer 4 in a section of a 3 cm×3 cm at a central portion of the palm side region of the glove 1.

A material of the plurality of particles 7 is not particularly limited, and is exemplified by a rubber, a resin, an inorganic substance, a natural material, and the like. Examples of the rubber include styrene-butadiene rubbers, nitrile-butadiene rubbers, urethane rubbers, isoprene rubbers, acryl rubbers, chloroprene rubbers, butyl rubbers, butadiene rubbers, fluorine rubbers, epichlorohydrin rubbers, ethylene-propylene rubbers, natural rubbers, and the like. Examples of the resin include polyvinyl chloride-based resins, acrylic resins, polyethylene-based resins, polypropylene-based resins, polystyrene-based resins, silicone-based resins, polyurethane-based resins, polyvinyl alcohol-based, resins, vinylidene chloride-based, resins, chlorinated polyethylene-based resins, polycarbonate (PC)-based resins, phenol-based resins, ethylene-vinyl alcohol copolymer resins, and the like. Examples of the inorganic substance include silica, alumina, zinc oxide, potassium titanate, calcium carbonate, calcium silicate, and the like. Examples of the natural material include walnut, chaff, and the like. These may be used either one type alone, or as a mixture of two or more types thereof. Among these, a rubber or a resin, is preferred in light of having elasticity, and being superior in abrasion resistance, etc., and a natural rubber is more preferred.

The shape of the particles 7 is exemplified by a spherical shape, a semi-spherical shape, a polyhedral shape, cubic shape, a needle shape, a rod shape, a spindle shape, a plate shape, a scale shape, a fiber shape, and the like. Of these, a spherical shape is preferred since the particle having a spherical shape are less likely to scratch the surface of an object to be gripped, and a polyhedral shape and a cubic shape are preferred since the particles are in contact with an object to be gripped at their corners and achieves the anti-slipping effect by means of their followability.

The mean particle size of the particles 7 is preferably no less than 50 μm and no greater than 900 μm, more preferably no less than 100 μm and no greater than 700 μm, still more preferably no less than 150 μm and no greater than 600 μm, and most preferably no less than 200 μm and no greater than 500 μm. When the mean particle size of the particles 7 is greater than the upper limit value described above, the particles 7 per se become so heavy that aggregation of the particles 7 may be prevented, or the particles 7 may be likely to be detached from the second coating layer 4. To the contrary, when the mean particle size of the particles 7 is less than the lower limit value described above, the particles 7 do not flow satisfactorily on the surface of the glove when the particle-clustering regions 5 are formed, and thus formation of the particle-clustering regions 5 may be difficult, or production of the particles 7 per se may be difficult. Note that the mean particle size is derived assuming that the particle size is the longest diameter of the particles 7.

The content of the particles 7 in terms of the solid content with respect to 100 parts by mass of the binder is preferably no less than 50 parts by mass and no greater than 500 parts by mass, more preferably no less than 50 parts by mass and no greater than 400 parts by mass, still more preferably no less than 100 parts by mass and no greater than 300 parts by mass, and most preferably no less than 150 parts by mass and no greater than 250 parts by mass. When the content of the particles 7 is greater than the upper limit value described above, the particle-clustering region 5 may be so broad that the unevenness of the surface of the glove 1 may be decreased, whereby the anti-slipping effect and flexibility may be deteriorated. To the contrary, when the content of the particles 7 is less than the lower limit value described above, the glove 1 may not achieve a sufficient anti-slipping effect. In order to achieve a sufficient anti-slipping effect by the glove 1, sufficiently many particles 7 are required and thus an increase in the amount of adhesion of the second coating layer 4 is necessary; however, when the amount of the binder 8 of the second coating layer 4 increases, the flexibility and moisture permeability of the glove 1 may be decreased.

The second coating layer 4 has moisture permeability. The moisture permeability is speculated to result from: the presence of voids (spaces) around the particles 7 of the particle-clustering regions 5; lamination of partially very thin regions 6 other than the particle-clustering regions; and attraction of the binder 8 to the particle-clustering region 5 by surface tension of the particles 7. The regions 6 other than the particle-clustering regions are constituted with a region that includes only the binder 8 described later, and a region that includes one particle 7 and the binder 8. Due to the second coating layer 4 having the moisture permeability, the glove 1 can exhibit moisture permeability, and thus even if the glove 1 is worn for a long period of time, generated moisture such as sweat can be released outside the glove 1, thereby enabling a superior wearing feel to be maintained.

The mean water vapor transmission rate of the glove 1 in the region on which the second coating layer 4 is laminated is preferably no less than 1,000 $g/m^2 \cdot 24$ hrs and no greater than 5,000 $g/m^2 \cdot 24$ hrs, more preferably no less than 1,200 $g/m^2 \cdot 24$ hrs and no greater than 4,000 $g/m^2 \cdot 24$ hrs, and still more preferably no less than 1,500 $g/m^2 \cdot 24$ hrs and no greater than 3,000 $g/m^2 \cdot 24$ hrs. When the mean water vapor transmission rate of the region on which the second coating layer 4 is laminated is greater than the upper limit value described above, the strength of the second coating layer 4 may be decreased. To the contrary, when the mean water vapor transmission rate is less than the lower limit value described above, attaining sufficient moisture permeability may fail, and thus a wearing feel of the glove 1 may be impaired.

As the binder 8, for example, a rubber, a resin or the like exemplified as the principal component of the first coating layer 3 may be used, which may be used either alone of one type, or as a mixture of two or more types thereof. In addition, the form of the material to be used as the binder 8 may be a latex in which the rubber, the resin or the like is dispersed in a diluent such as water. Of these, in light of superior elasticity, processibility and economical efficiency, rubbers are preferred, and natural rubbers are more preferred. Moreover, in light of the moisture permeability being superior, moisture permeable polyurethane-based resins are preferred. By using the moisture permeable polyurethane-based resin as a binder 8, moisture permeability of the regions 6 other than the particle-clustering regions can be improved. Furthermore, it is preferred that the binder 8 of the same type as that of the particles 7 be used. When the binder 8 is the same type as that of the particles 7, adhesiveness between the binder 8 and the particles 7 can be improved.

The binder 8 may further contain other additive in addition to the rubber or the resin. The other additive is exemplified by a vulcanization accelerator, a vulcanization agent, an antioxidant, a metal oxide, a pigment, a thickener, a plasticizer, a stabilizer, and the like used in the first coating layer 3.

The mean thickness of the second coating layer 4 is preferably no less than 0.05 mm and no greater than 1.1 mm, and more preferably no less than 0.1 mm and no greater than 0.7 mm. When the mean thickness of the second coating layer 4 is greater than the upper limit value described above, flexibility of the second coating layer 4 may be decreased. To the contrary, when the mean thickness of the second coating layer 4 is less than the lower limit value described above, formation of the second coating layer 4 may be difficult, and the strength of the second coating layer 4 may be decreased. Note that the mean thickness of the second coating layer 4 is an average value obtained by measuring the thicknesses of arbitrary five points in the palm region where the particle-clustering regions 5 are formed using "Digital Microscope VHX-900" manufactured by Keyence Corporation.

According to the glove 1 constructed as described above, the first coating layer 3 and the second coating layer 4 are laminated on the external surface of the glove body 2, and the second coating layer 4 has particle-clustering regions 5 constituted with a plurality of particles 7 and the binder 8 thereof, whereby an irregular uneven shape is formed on the surface, and thus a superior anti-slipping effect is achieved. In addition, since the particle-clustering regions 5 are scattering over the surface, the glove 1 has superior flexibility. Since the first coating layer 3 has moisture permeability in the glove 1, the moisture such as sweat generated from a worker's hand can be released outside the glove 1 even if worn for a long period of time, thereby enabling a superior wearing feel to be maintained. In addition, due to the presence of the pores 9 contained in the first coating layer 3, weight reduction and improvement of flexibility are achieved; therefore, fatigue of hands is less likely to occur even if the glove 1 is worn for a long period of time, and thus the working efficiency can be improved.

In addition, since the particle-clustering regions 5 are formed to have a top face that is substantially flat in the glove 1, due to an increase in the surface area to be in contact with the object to be gripped, a superior anti-slipping effect is achieved. Furthermore, since the second coating layer 4 is further laminated on the surface of the first coating layer 3 according to the glove 1, superior elasticity and abrasion resistance as a glove are attained.

Method for Producing Glove 1

Next, a method for producing the glove 1 that has the configuration described above will be briefly explained, but the method for producing a glove of the present invention is not limited thereto.

The method for producing the glove 1 includes: a first coating layer-forming step for forming the first coating layer 3 at least on a palm side region of the external surface of the glove body 2 made from fibers using a first coating layer-forming material; and a second coating layer-forming step for forming the second coating layer 4 at least on a part of the external surface of the first coating layer 3 formed in the previous step by further overlaying a second coating layer-forming material containing a plurality of particles 7 and a binder 8 thereof.

First Coating Layer-Forming Step

In the first coating layer-forming step, the first coating layer-forming material prepared beforehand is applied at least onto a palm side region of the external surface of the glove body 2 made from fibers, and is hardened to form the first coating layer 3. The first coating layer-forming material can be prepared by adding a diluent and other additive (s) to a rubber, a resin or the like that serves as a principal component.

Examples of the diluent include water, a plasticizer, an organic solvent, and the like. Examples of the organic solvent include dimethylformamide, dimethylacetamide, dimethylsulfoxide, N-methylpyrrolidone, isopropyl alcohol, xylene, and the like. These may be used either alone, or in combination of two or more types thereof.

The first coating layer-forming material has a plurality of pores 9. The process for foaming the first coating layer-forming material may include, for example, mechanical foaming, chemical foaming, and the like. The mechanical foaming is a process for foaming including stirring the first coating layer-forming material using a mixer or the like. The chemical foaming is a process for foaming including adding a chemical foaming agent to the first coating layer-forming material and utilizing thermal expansion, etc. Examples of such a chemical foaming agent include toluenesulfonyl hydrazide, PP'-oxybis(benzosulfonylhydrazide), azodicarbonamide, azobisisobutyronitrile, etc., as well as thermal expansive microcapsules, and the like. The amount of the chemical foaming agent added is preferably no greater than 5 parts by mass in terms of the solid content with respect to 100 parts by mass of the principal component of the first coating layer 3. When the amount of the chemical foaming agent added is greater than the upper limit value described above, the foaming effects comparable to those achievable by the additive amount are impaired, and thus economical efficiency may be lowered. The chemical foaming agents are likely to form independent pores and the pores are less likely to be interconnected. However, the chemical foaming agents are advantageous in that the size of the pores can be easily controlled. Therefore, carrying out the mechanical foaming is preferred, and in order to improve foaming properties, the mechanical foaming is preferably employed in combination with the foaming using the chemical foaming agent in order to improve the foamability according to the purpose.

In order to stabilize the pores 9, a frothing agent or a foam-stabilizing agent may be also used. Examples of the frothing agent include sodium alkylsuccinate, alkylmonoamide disodium sulfosuccinate, potassium oleate, castor oil potassium, sodium dodecylbenzenesulfonate, and the like. Examples of the foam-stabilizing agent include silicone based compounds, ammonium stearate, peptide, sodium alkyldipropionate, and the like. Note that there is no definite discrimination, between the frothing agent and the foam-stabilizing agent, and a compound exemplified as the frothing agent may also be used as the foam-stabilizing agent, or a compound exemplified as the foam-stabilizing agent may be also used as the frothing agent. The amount of the frothing agent or foam-stabilizing agent added is preferably no less than 0.1 parts by mass and no greater than 15 parts by mass in terms of the solid content with respect to 100 parts by mass of the principal component of the first coating layer 3. When the amount of the frothing agent or foam-stabilizing agent added is greater than the upper limit value described above, the pore stabilizing effects comparable to those achievable by the additive amount are impaired, and thus economical efficiency may be lowered. To the contrary, when the amount of the frothing agent or foam-stabilizing agent added is less than the lower limit value described above, sufficient effects may not be achieved.

The first coating layer-forming material is preferably provided as a dispersion (latex or emulsion) of the principal component, a solution of the principal component, or a paste sol of the principal component in light of processibility. The percentage of the volume of gas (mainly air) included in the first coating layer-forming material is preferably no less than 10% by volume and no greater than 100% by volume, and more preferably no less than 20% by volume and no greater than 50% by volume. When the percentage of the volume of the gas contained in the first coating layer-forming material is greater than the upper limit value described above, the foamed first coating layer-forming material is likely to accumulate at crotch portions of fingers, whereby the processibility may be deteriorated, and the abrasion resistance and strength of the resultant first coating layer 3 may be decreased. To the contrary, when the percentage of the volume of the gas included in the first coating layer-forming material is less than the lower limit value described above, the foamed first coating layer-forming material is readily impregnated into the glove body 2, whereby the processibility may be deteriorated, and the resultant first coating layer 3 may not have sufficient moisture permeability and flexibility. The volume of gas contained in the first coating layer-forming material can be determined by the following formula. In the following formula, (A) represents a volume of 50 g of the first coating layer-forming material before foaming, and (B) represents a volume of 50 g of the first coating layer-forming material after foaming.

$$[((B)-(A))/(B)]\times 100(\%)$$

The total solid content (TSC) of the first coating layer-forming material is, for example, in the case in which water is used as a diluent, preferably no less than 30% by mass and no greater than 65% by mass, and more preferably no less than 35% by mass and no greater than 60% by mass. When the total solid content of the first coating layer-forming material is greater than the upper limit value described above, formation of the first coating layer 3 may be difficult, and the thickness of the first coating layer 3 may be so great that the flexibility of the glove 1 may be decreased. To the contrary, when the total solid content of the first coating layer-forming material is less than the lower limit value described above, the form coating film of the first coating layer 3 can be so thin that the strength may be decreased, and may be likely to penetrate into an inner face of the glove, whereby a feel upon touch of the glove may be deteriorated.

The viscosity of the first coating layer-forming material is, for example, in the case in which mechanical foaming is employed, preferably no less than 1,000 mPa·s and no greater than 6,000 mPa·s, more preferably no less than 2,000 mPa·s and no greater than 5,000 mPa·s, and still more preferably no less than 2,000 mPa·s and no greater than 4,000 mPa·s in terms of the viscosity after the mechanical foaming. In addition, in the case of a paste sol in which a plasticizer is used as a diluent, the viscosity after foaming the first coating layer-forming material is preferably no less than 2,000 mPa·s and no greater than 8,000 mPa·s, and more preferably no less than 3,000 mPa·s and no greater than 6,000 mPa·s. Alternatively, in the case in which polyurethane prepared using an organic solvent as a diluent is molded by a wet processing, the viscosity of the first coating layer-forming material is preferably no less than 50 mPa·s and no greater than 1,000 mPa·s, and more preferably no less than 100 mPa·s and no greater than 500 mPa·s. It is to be noted that when polyurethane in which an organic solvent is used as a diluent is subjected to a wet processing, the pores 9 are formed (cell formation) by the wet processing; therefore, addition of a chemical foaming agent and/or a mechanical foaming treatment would be unnecessary. When the viscosity of the first coating layer-forming material is greater than the upper limit value described above, the first coating layer 3 can be so thick that formation of the glove may be difficult. To the contrary, when the total solid content of the first coating layer-forming material is less than the lower limit value described above, a coating film of the formed first coating layer 3 becomes so thin that the strength may be decreased, or penetration into the inner face of the glove may lead to deterioration of the feel upon touch of the glove. Moreover, in the case of the chemical foaming, the viscosity is acceptable as long as penetration of the coating layer-forming material into the glove 2 can be avoided according to the molding method selected. It is to be noted that the viscosity is a $V_6$ value measured using a BM type viscometer (manufactured by TOKIMEC INC. (currently TOKYO KEIKI INC.)).

A pH-adjusting agent may be used in order to control the viscosity of the first coating layer-forming material to adjust the thickness of the coating film. Examples of the pH-adjusting agent include alkalis such as potassium hydroxide and ammonia, and weak acids such as e.g., amino acids and acetic acid. These may be used either alone, or in combination of two or more types thereof.

The method for applying the first coating layer-forming material to the surface of the glove body 2 is not particularly limited, and exemplary methods involve methods of permitting application by an immersion process or showering, and the like. In particular, in light of capability of easily forming a uniform coating film, an immersion process is preferred. In addition, prior to the application of the first coating layer-forming material to the glove body 2, the glove body 2 may be subjected to a water repellent finishing.

The method for hardening the first coating layer-forming material may involve, for example, acid coagulation, heat coagulation, salt coagulation, air drying, and the like. Among these, acid coagulation is preferred since immediate gelation is enabled in the case in which the first coating layer-forming material is a latex or an emulsion, and the pores 9 are likely to be retained in the first coating layer 3. Acid coagulation is a process in which the glove body 2 to which the first coating layer-forming material was applied is immersed in an aqueous coagulant solution such as an aqueous acetic acid solution or an aqueous formic acid solution to allow for hardening. The aqueous coagulant solution may vary depending on the type of the coagulant, and for example, in the case of an aqueous acetic acid solution, the solution may have a concentration of about 10%.

Second Coating Layer-Forming Step

In the second coating layer-forming step, the second coating layer-forming material prepared beforehand is overlaid at least on a part of the external surface of the first coating layer 3 formed in the first coating layer-forming step, whereby the second coating layer 4 is formed. The second coating layer-forming material contains the binder 8 and the particles 7, and can be prepared by further adding a diluent and other additive(s) ad libitum.

The total solid content of the second coating layer-forming material is appropriately selected in accordance with the component of the second coating layer-forming material, and intended use of the glove 1, and in the case in which a latex or an emulsion is used as the material, the solid content is preferably no less than 20% by mass and no greater than 60% by mass, and more preferably no less than 25% by mass and no greater than 45% by mass. When the total solid content of the second coating layer-forming material is greater than the upper limit value described above, flexibility of the second coating layer 4 may be decreased. To the contrary, when the total solid content of the second coating layer-forming material is less than the lower limit value described above, although the flexibility is attained, the coating film of the second coating layer 4 may be so thin that formation of the particle-clustering regions 5 may be difficult, and the anti-slipping effect or the abrasion resistance of the glove 1 may be impaired.

The viscosity of the second coating layer-forming material may be appropriately selected depending on the component of the second coating layer-forming material, and is preferably no less than 100 mPa·s and no greater than 900 mPa·s, more preferably no less than 100 mPa·s and no greater than 800 mPa·s, still more preferably no less than 100 mPa·s and no greater than 700 mPa·s, and most preferably no less than 150 mPa·s and no greater than 500 mPa·s. In the case in which the viscosity of the second coating layer-forming material is greater than the upper limit value described above, the flexibility of the second coating layer 4 may be decreased, and thus the particles 7 are less likely to move on the surface of the glove, whereby formation of the particle-clustering regions 5 may be difficult. To the contrary, when the viscosity of the second coating layer-forming material is less than the lower limit value described above, the particles 7 are flown down together with the binder 8 from the glove, making formation of the particle-clustering regions 5 difficult, whereby the anti-slipping effect of the glove 1 may be deteriorated. It is to be noted that the viscosity is a $V_6$ value measured using a BM type viscometer (manufactured by TOKIMEC INC. (currently TOKYO KEIKI INC.)).

Furthermore, a thickener may be used in order to adjust the viscosity of the second coating layer-forming material to fall within the above numerical range. The thickener is exemplified by hydroxypropyl methylcellulose, acryl emulsion, silica fine powder, calcium carbonate powder, and the like.

Additionally, a surfactant may be used when the particles 7 are aggregated, in order to facilitate movement of the particles 7 while reducing the hardening speed of the binder 8. The surfactant is exemplified by anionic surfactants, cationic surfactants, nonionic surfactants and the like. Among these, nonionic surfactants are preferred, and polyoxyethylene alkylphenyl ether is more preferred. The amount of the surfactant blended is preferably no less than 5 parts by mass and no greater than 25 parts by mass in terms of the solid content with respect to 100 parts by mass of the solid content of the binder 8 of the second coating layer-forming material. When the amount of the surfactant blended is greater than the upper limit value described above, the hardening speed of the binder 8 can be so low that the particles 7 may slide down, whereby formation of the particle-clustering regions 5 may be difficult. To the contrary, when the amount of the surfactant blended is less than the lower limit value described above, the second coating layer-forming material is likely to be gelated, whereby the stability may be decreased.

The second coating layer-forming material may contain in addition to the binder 8 and the particles 7, the diluent and the other additive(s) used in the first coating layer-forming step.

The second coating layer-forming material is overlaid on the external surface of the first coating layer 3 by an immersion process. Specifically, the glove body 2 on which the first, coating layer 3 was formed is immersed in the second coating layer-forming material such that an area of a certain width surrounding the palm side region covering from the external margin of the first coating layer 3 to an inner circumference remains, i.e., forming an unlined back, as generally referred to, to overlay the second coating layer-forming material.

Thereafter, the particle-clustering regions 5 are formed by allowing the second coating layer-forming material to flow, thereby aggregating a plurality of particles 7. The process for allowing the second coating layer-forming material to flow is not particularly limited as long as the particles 7 can be moved. For example, after overlaying with the second coating layer-forming material: a process including retaining the glove body 2 in a state in which fingertip portions are directed downward or fingertip portions are directed upward; a process including blowing air thereto; a process including retaining the same in a state in which a thumb portion side is directed downward whereas a pinkie portion side is directed upward, or in a state in which a thumb portion side is directed upward whereas a pinkie portion side is directed downward, and the like may be exemplified. Among these, the method including retaining the glove in a state in which fingertip portions are directed downward is preferred, due to a good appearance of the finished glove since unnecessary particles 7 and binder 8 can be dropped from the fingertip portions. Accordingly, a plurality of particles 7 move downward on the surface of the glove together with the binder 8, and a plurality of the particles 7 are aggregated while moving, whereby a plurality of particle-clustering regions 5 are formed. As a result, an irregular uneven shape is formed on the surface of the glove 1, and thus an anti-slipping effect is imparted to the glove 1.

After a plurality of particle-clustering regions 5 were formed, the glove is dried in an oven or the like to obtain the glove 1. Drying conditions are not particularly limited as long as they allow the second coating layer-forming material to be hardened, and, for example, the drying may be carried out at 120° C. for about 10 min to 60 min.

OTHER EMBODIMENTS

The present invention can be put into practice in aspects with various modifications and improvements further to the aspects described above. In the first coating layer-forming step, before applying the first coating layer-forming material to the glove body 2, the surface of the glove body 2 may be treated with a coagulant. By thus subjecting the glove body 2 to a surface treatment with a coagulant, the shape of pores in the first coating layer is likely to be maintained, and a drying time of the first coating layer-forming material can be shortened. Specifically, the glove body 2 set on a glove mold is immersed in a coagulant solution prepared beforehand, and immediately withdrawn. The glove body 2 may be dried with an oven, a dryer or the like. An exemplary coagulant solution is prepared by adding 3 parts by mass of calcium nitrate to 100 parts by mass of methanol, and the like.

Also, a coupling agent may be added to the binder 8 in order to improve the adhesive force between the particles 7 and the binder 8. Examples of the coupling agent include a silane coupling agent, a titanate-based coupling agent, an aluminate-based coupling agent, and the like. Of these, the silane coupling agent superior in versatility is preferred. The amount of the coupling agent added is preferably no less than 1 part by mass and no greater than 10 parts by mass in terms of the solid content with respect to 100 parts by mass of the principal component of the second coating layer-forming material. When the amount of the coupling agent added is less than the lower limit value described above, sufficient adhesiveness may not be obtained. To the contrary, when the amount of the coupling agent added is greater than the upper limit value described above, a further effect by the addition in such an amount can not be achieved, and may rather lead to the deterioration of strength, etc. of the binder 8.

Moreover, although the first coating layer 3 and the second coating layer 4 are formed to have unlined back in the embodiment described above, the first coating layer 3 and the second coating layer 4 may be entirely formed on the glove including the back side.

EXAMPLES

Hereinafter, the present invention will be explained in detail by way of Examples and Comparative Examples, but the invention is not limited to the following Examples.

Example 1

Production of Glove Body

A glove body was knitted using a thread obtained by aligning two pieces of a cotton thread having a cotton yarn number of 20 and two pieces of a polyester spun yarn having a yarn number of 20, and using a 10-gauge flat knitting machine (model "N-SFG", manufactured by SHIMA SEIKI MFG., LTD.).

First Coating Layer-Forming Step

The knitted glove body was set on a glove mold, and heated in an oven at 80° C. for 20 min. Subsequently, a first coating layer-forming material prepared according to the following Table 1 was subjected to mechanical foaming with a mixer, and inclusion of 45% by volume of air was permitted. Thereafter, the glove body including the glove mold was immersed in the first coating layer-forming material such that the palm side region and the back side of the fingertips of the glove body are submerged, and then withdrawn. Next, immediately after withdrawn, the glove body was immersed in a 10% by mass aqueous acetic acid solution to carry out acid coagulation of the first coating layer-forming material. Thereafter, the glove was dried with an oven at 120° C. in order to evaporate the aqueous acetic acid solution.

First Coating Layer-Forming Material

The blend ratio of the first coating layer-forming material used in the first coating layer-forming step is shown below. The total solid content (TSC) of the first coating layer-forming material was 55% by mass, and the viscosity thereof was 2940 mPa·s.

TABLE 1

| Component | Additive amount* (parts by mass) |
|---|---|
| natural rubber latex (trade name "LATZ": manufactured by Kilang Getah Bukit Perak) | 100 |
| wax emulsion (trade name "VIVASHIELD 9176": manufactured by H&R WAX (M) SDN. BHD.) | 2 |
| sulfur (crosslinking agent) | 1 |
| zinc oxide (metal oxide) | 1 |
| 2,2-methylene-bis(4-methyl-6-tert-butyl-phenol) (anti-aging agent) | 1 |

TABLE 1-continued

| Component | Additive amount* (parts by mass) |
|---|---|
| potassium hydroxide (pH-adjusting agent) | 0.2 |
| zinc diethyldithiocarbamate (vulcanization accelerator) | 0.2 |
| sodium alkylsuccinate (frothing agent) | 0.2 |
| pigment | as required |
| hydroxypropyl methylcellulose (thickener) | as required |

*presented in terms of the solid content

Second Coating Layer-Forming Step

The glove body on which the first coating layer was formed was immersed in a second coating layer-forming material prepared according to the following Table 2 such that the second coating layer was not applied to an area of a width of about no less than 5 mm and no greater than 10 mm inside from the external margin of the first coating layer, and then the glove body was withdrawn. Subsequently, the particles were aggregated by retaining the glove body in a state in which fingertip portions are directed downward for 150 sec to allow the second coating layer-forming material to flow, whereby particle-clustering regions were formed. Thereafter, the second coating layer-forming material was hardened by heating with an oven at 120° C. for 10 min, and thereafter the glove was released from the glove mold. Then the glove was leached in water to remove remaining emulsifying agent and surfactant. Furthermore, the leached glove was again set on the glove mold and dried with an oven at 120° C. for 40 min to obtain the glove of the present invention. The glove obtained had a water vapor transmission rate in a region at a central portion of the palm side as determined according to a JIS T9010A method of 2,000 $g/m^2 \cdot 24$ hrs, and thus had sufficient moisture permeability. In addition, the glove obtained had superior flexibility and abrasion resistance, without detachment of the particles found.

Second Coating Layer-Forming Material

The blend ratio of the second coating layer-forming material used in the second coating layer-forming, step is shown below. The total solid content (TSC) and the viscosity of the second coating layer-forming material are shown in Table below.

TABLE 2

| Component | Additive amount* (parts by mass) |
|---|---|
| natural rubber (trade name "MG-15": manufactured by GREEN HPSP (M) SDN BHD) | 100 |
| natural rubber powder (passed through a 80 mesh; mean particle size: 150 μm) | 200 |
| polyoxyethylene alkylphenyl ether (surfactant) | 20 |
| potassium hydroxide (pH-adjusting agent) | 6 |
| acryl emulsion (thickener) | as required |
| pigment | as required |

*presented in terms of the solid content

Examples 2 to 6

The gloves of Examples 2 to 6 were obtained in a similar manner to the aforementioned Example 1 except that the mean particle size of the particles used for the second coating layer-forming material was changed as shown in Table 3 below.

Examples 7 to 13, and Comparative Example 1

The gloves of Examples 7 to 13 and Comparative Example 1 were obtained in a similar manner to the Example 1 except that the amount of blended particles used for the second coating layer-forming material was changed to values shown in Table 3 below.

Examples 14 to 18

The gloves of Examples 14 to 18 were obtained in a similar manner to the Example 1 except that the viscosity of the second coating layer-forming material was changed to values shown in Table 3 below.

Flexibility Test

Ten subjects wore the gloves of Examples 1 to 20, and bending and stretching of fingers was conducted. The force applied to the hand in bending and stretching fingers was evaluated according to evaluation criteria, and an average of the evaluation was determined. The results are shown in Table 4 below.

Evaluation Criteria of Flexibility

A: being very superior in flexibility, and extremely favorable in bending and stretching of fingers B: being superior in flexibility, and favorable in bending and stretching of fingers C: having flexibility, without being accompanied by a problem in bending and stretching of fingers D: between C and E E: having no flexibility, and accompanied by a difficulty in bending and stretching of fingers

TABLE 3

| | Second coating layer | | | | | |
|---|---|---|---|---|---|---|
| | Mean particle size (μm) | Amount of particles blended (parts by mass) | Viscosity (mPa · s) | Total solid content (TSC) (%) | Area percentage of particle-clustering region (%) | Moisture permeability ($m^2$ · 24 hrs) |
| Example 1 | 150 | 200 | 205 | 36.1 | 40 | 2,000 |
| Example 2 | 265 | 200 | 198 | 36.1 | 45 | 2,500 |
| Example 3 | 401 | 200 | 200 | 36.1 | 46 | 2,300 |
| Example 4 | 535 | 200 | 211 | 36.1 | 49 | 2,200 |
| Example 5 | 700 | 200 | 196 | 36.1 | 51 | 2,300 |
| Example 6 | 983 | 200 | 203 | 36.1 | 16 | 1,300 |
| Example 7 | 265 | 50 | 202 | 23.6 | 29 | 1,100 |
| Example 8 | 265 | 100 | 196 | 28.3 | 35 | 1,500 |
| Example 9 | 265 | 150 | 205 | 32.4 | 41 | 2,000 |
| Example 10 | 265 | 250 | 202 | 39.4 | 54 | 2,000 |
| Example 11 | 265 | 300 | 211 | 42.3 | 70 | 1,600 |
| Example 12 | 265 | 400 | 215 | 47.5 | 88 | 1,100 |
| Example 13 | 265 | 600 | 220 | 55.4 | 97 | 800 |
| Example 14 | 265 | 200 | 149 | 36.1 | 41 | 3,500 |
| Example 15 | 265 | 200 | 400 | 36.1 | 46 | 2,000 |
| Example 16 | 265 | 200 | 610 | 36.1 | 47 | 1,800 |
| Example 17 | 265 | 200 | 790 | 36.1 | 51 | 1,100 |
| Example 18 | 265 | 200 | 1010 | 36.1 | 55 | 800 |
| Comparative Example 1 | 265 | 0 | 199 | 18.3 | — | 800 |

Anti-Slipping Effect Test

Ten subjects wore the gloves of Examples 1 to 20, and gripped a wet glass tumbler having a diameter of 8 cm and a height of 15 cm. An anti-slipping effect in the gripping was evaluated according to the following evaluation criteria, and an average of the evaluation was determined. The results are shown in Table 4 below.

Evaluation Criteria of Anti-Slipping Effect

A: not being slippery indicating a very superior anti-slipping effect

B: being hardly slippery indicating a superior anti-slipping effect

C: being somewhat slippery indicating a somewhat superior anti-slipping effect

D: between C and E

E: being slippery indicating an inferior anti-slipping effect

Abrasion Resistance Test

In an abrasion resistance test, the number of times of friction was counted according to "Protective gloves against mechanical risks; 6.1 Abrasion resistance" in European Union standards EN388: 2003. A greater numerical value suggests that the number of times of friction until abrasion was greater, indicating superior abrasion resistance.

TABLE 4

| | Anti-slipping effect | Abrasion resistance | Flexibility |
|---|---|---|---|
| Example 1 | B | 500 | A |
| Example 2 | A | 500 | A |
| Example 3 | A | 500 | A |
| Example 4 | B | 500 | B |
| Example 5 | C | 500 | C |
| Example 6 | D | 400 | C |
| Example 7 | A | 400 | A |
| Example 8 | A | 400 | A |
| Example 9 | A | 500 | A |
| Example 10 | A | 500 | A |
| Example 11 | B | 500 | B |
| Example 12 | D | 800 | D |
| Example 13 | C | 800 | E |
| Example 14 | B | 500 | A |
| Example 15 | A | 500 | B |
| Example 16 | A | 500 | B |
| Example 17 | D | 800 | D |
| Example 18 | D | 800 | E |
| Comparative Example 1 | E | 300 | A |

INDUSTRIAL APPLICABILITY

As in the foregoing, since the glove of the present invention and a glove obtained by the production method of the present invention achieve a superior anti-slipping effect, moisture permeability and abrasion resistance, they can be suitably used as a glove for working, in particular.

1 glove
2 glove body
3 first coating layer
4 second coating layer
5 particle-clustering region.
6 region other than particle-clustering region
7 particle
8 binder
9 pore

What is claimed is:

1. A glove comprising:

a glove body made from fibers;

a first coating layer being applied at least on a palm side region of an external surface of the glove body, and containing a plurality of pores; and a second coating layer being laminated at least on a part of an external surface of the first coating layer, and comprising a plurality of particles and a binder thereof, the second coating layer having particle clustering regions that are scattering, and regions free of particle-clustering, the particle-clustering regions each having a substantially flat top face and being elevated from the regions free of particle-clustering.

2. The glove according to claim 1, wherein the pores comprise interconnected cells.

3. The glove according to claim 1, wherein regions free of particle-clustering of the second coating layer have moisture permeability.

4. The glove according to claim 1, wherein a percentage of a total area of the particle clustering regions with respect to an area of the second coating layer is no less than 20% and no greater than 90%.

5. The glove according to claim 1, wherein a mean particle size of the particles is no less than 50 μm and no greater than 900 μm.

6. The glove according to claim 1, wherein a content of the particles is no less than 50 parts by mass and no greater than 500 parts by mass in terms of a solid content with respect to 100 parts by mass of the binder of the second coating layer.

7. The glove according to claim 1, wherein a mean water vapor transmission rate of a region on which the second coating layer is laminated is no less than 1,000 $g/m^2 \cdot 24$ hrs.

8. The glove according to claim 1, wherein the particles are made of a rubber or a resin.

* * * * *